US011061371B1

(12) United States Patent
Oberson

(10) Patent No.: US 11,061,371 B1
(45) Date of Patent: Jul. 13, 2021

(54) MOIRÉ-EFFECT WINDING ASSEMBLY FOR AUTOMATIC TIMEPIECE MOVEMENT

(71) Applicant: The Swatch Group Research and Development Ltd, Marin (CH)

(72) Inventor: Loic Oberson, St-Prex (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 17/111,928

(22) Filed: Dec. 4, 2020

(30) Foreign Application Priority Data

Dec. 19, 2019 (EP) ..... 19217903

(51) Int. Cl.
*G04B 5/16* (2006.01)
*G04B 45/00* (2006.01)
*G04B 5/10* (2006.01)

(52) U.S. Cl.
CPC ..... *G04B 5/16* (2013.01); *G04B 5/10* (2013.01); *G04B 45/0007* (2013.01)

(58) Field of Classification Search
CPC ... G04B 5/00; G04B 5/10; G04B 5/16; G04B 5/165; G04B 45/0007; G04B 45/0015
See application file for complete search history.

(56) References Cited

U.S. PATENT DOCUMENTS

| | | | |
|---|---|---|---|
| 5,586,089 | A | 12/1996 | McGarvey |
| 2018/0341229 | A1 | 11/2018 | Oliveira et al. |
| 2019/0018367 | A1 | 1/2019 | Rachdi et al. |

FOREIGN PATENT DOCUMENTS

| | | | |
|---|---|---|---|
| CH | 707 999 | | 10/2014 |
| DE | 196 47 715 | | 5/1998 |
| EP | 3 428 737 | A1 | 1/2019 |
| FR | 1 135 725 | | 5/1957 |
| JP | 2013-185936 | A | 9/2013 |
| JP | 2019-20396 | A | 2/2019 |
| JP | 2019-23616 | A | 2/2019 |
| WO | 2008/062247 | | 5/2008 |

OTHER PUBLICATIONS

European Search Report dated Jun. 24, 2020, in European Application No. 19217903.4. pp. 4.
European Search Report dated Jun. 24, 2020, in corresponding European Patent Application No. 19217903.4 (with English translation) (7 pages).
Notice of the Reason for Refusal dated Jan. 12, 2021 in corresponding Japanese Patent Application No. 2020-190658 (with English translation) (4 pages).

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A moiré-effect winding assembly for an automatic timepiece movement includes an oscillating winding mass which is movable relative to the movement. The winding mass is to be mounted to rotate on an axis of the movement. Part of the winding mass forms a heavy part allowing the mass to oscillate in response to the movement of the timepiece and to the force of gravity. The assembly also includes an element that is stationary relative to the movement. The stationary element is arranged under the winding mass. The winding mass at least partly displaces above the stationary element. The stationary element includes a first relief pattern and the winding mass includes a plurality of through openings defining a second pattern, so as to create a dynamic moiré effect when the winding mass displaces above the stationary element.

16 Claims, 1 Drawing Sheet

MOIRÉ-EFFECT WINDING ASSEMBLY FOR AUTOMATIC TIMEPIECE MOVEMENT

CROSS-REFERENCE TO RELATED APPLICATION

The present application claims priority to European Patent Application No. 19217903.4, filed on Dec. 19, 2019, the entire content and disclosure of which are incorporated by reference herein.

FIELD OF THE INVENTION

The present invention relates to a moiré-effect winding assembly for automatic timepiece movement. More particularly, the invention relates to such a winding assembly intended to equip a wristwatch including a transparent back.

BACKGROUND OF THE INVENTION

Wristwatches are already known which have cases with a transparent back to allow their movement to be observed. However, when these watches include an automatic winding movement, the oscillating winding mass hides a movement part.

Furthermore, the aesthetics of such oscillating masses are not always pleasing, although it is possible to engrave the material forming the oscillating weight to make it more attractive. It is for example possible to engrave a logo representing the brand of the watch. But this logo is usually not showy enough, nor original enough in itself for the result to be aesthetically successful.

SUMMARY OF THE INVENTION

The object of the present invention is to overcome the disadvantages of the prior art by proposing an oscillating dynamic moiré-effect winding mass for a timepiece.

To this end, the object of the invention is a moiré-effect winding assembly for an automatic timepiece movement, the assembly comprising an oscillating winding mass which is movable relative to the movement, said winding mass being intended to be mounted to rotate on an axis of the movement, part of the winding mass forming a heavy part allowing the mass to oscillate in response to the movement of the timepiece and to the force of gravity.

The invention is remarkable in that the assembly comprises an element which is stationary relative to the movement, said stationary element being arranged under the winding mass, the movable mass being configured to at least partly displace above the stationary element, said stationary element comprising a first relief pattern and the winding mass including a plurality of through openings defining a second pattern, so as to create a dynamic moiré effect when the winding mass displaces above the stationary element.

Thanks to this winding assembly, a dynamic moiré effect created by the movement of the winding mass on the stationary element is obtained. Indeed, the displacement of the second open-work pattern above the first relief pattern generates a moiré-type optical effect. The moiré effect allows to create an impression of shape movement thanks to the relative displacement of the two patterns. Depending on the configuration of the patterns, a predefined shape can be created and dynamically animated thanks to the path travelled by the movable mass on the stationary element. Thus, the movement of the winding mass has a more attractive aesthetic result than a conventional winding mass known from the prior art. This winding assembly gives more character to the winding mass and therefore to the timepiece comprising the automatic movement provided with this assembly.

According to a particular embodiment of the invention, the winding mass comprises amorphous metal, for example a zirconium-based alloy, preferably entirely except for the heavy part.

According to a particular embodiment of the invention, the winding mass includes a first open-work structure forming the second pattern.

According to a particular embodiment of the invention, the winding mass includes a ring wherein the first structure is assembled.

According to a particular embodiment of the invention, the stationary element comprises a second open-work structure forming the first pattern.

According to a particular embodiment of the invention, the first and the second structure are identical.

According to a particular embodiment of the invention, the first and the second structure have substantially equal dimensions.

According to a particular embodiment of the invention, the first and the second structure have the shape of a multi-stranded spiral.

According to a particular embodiment of the invention, the winding mass comprises a high density insert forming the heavy part of the winding mass.

According to a particular embodiment of the invention, the insert comprises a high density material, with a density greater than 10, preferably greater than 20, for example tungsten or a tungsten alloy.

According to a particular embodiment of the invention, the insert is overmoulded on the ring.

The invention also relates to a timepiece including a case formed of a middle part closed by a crystal and an at least partially transparent back and wherein is housed an automatic winding horological movement, said movement being equipped with an oscillating winding assembly as defined above.

BRIEF DESCRIPTION OF THE DRAWINGS

Other details of the invention will emerge more clearly upon reading the following description, given with reference to the appended drawings wherein.

DETAILED DESCRIPTION OF A PREFERRED EMBODIMENT

Figure 1:
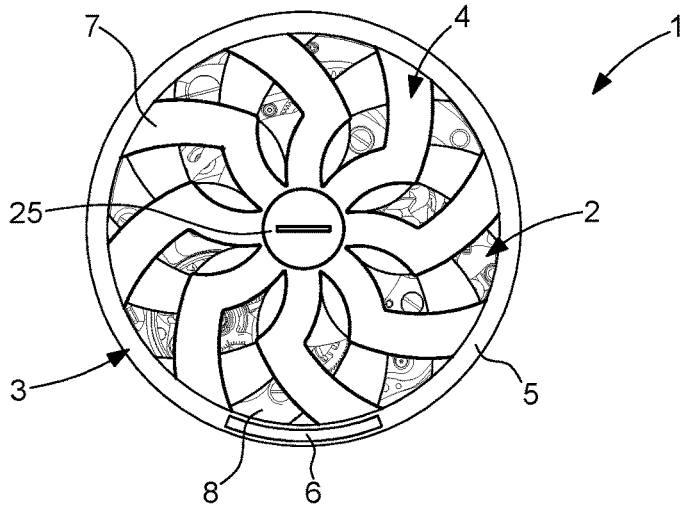
FIG. 1 is a plan view of a first embodiment according to the invention, of a winding assembly mounted on an automatic movement.
Figure 2:
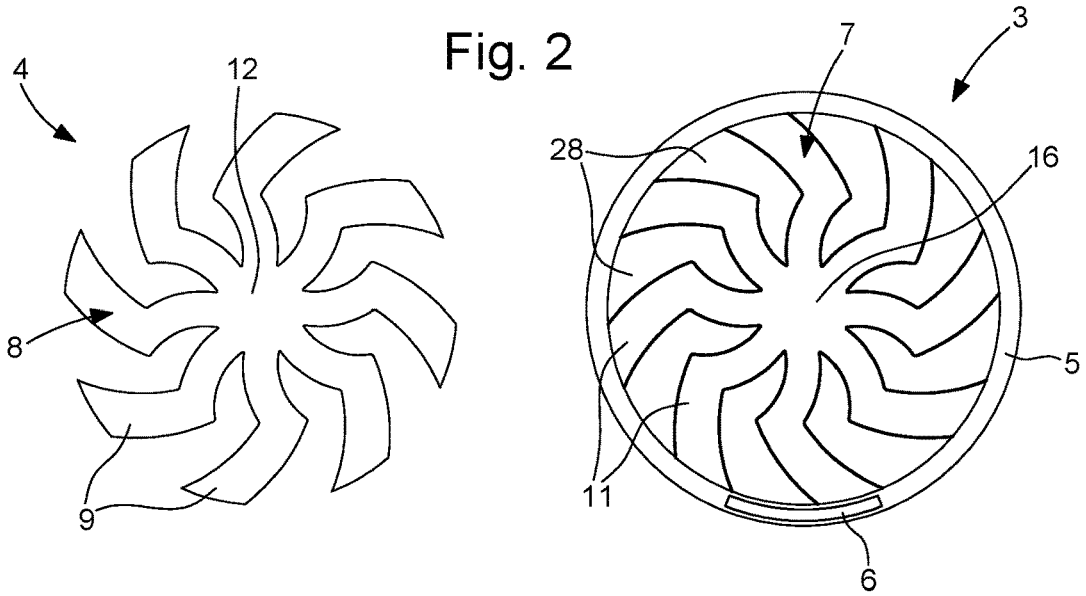
FIG. 2 is a plan view of the stationary element and the movable mass which are separated.

FIGS. 1 and 2 show an embodiment of a dynamic moiré-effect winding assembly for an automatic timepiece movement according to the invention, designated by the general reference 1. This assembly 1 is conventionally intended to equip the automatic winding movement 2 of a timepiece, the timepiece including in particular a case formed of a middle part closed by a crystal and an at least partially transparent back to make the movement 2 visible from the back, and which are not shown in the figure.

The assembly 1 comprises an oscillating winding mass 3 which is movable relative to the movement 2, said winding mass 3 being intended to be mounted to rotate on an axis 25 of the movement 2.

The winding mass 1 comprises a heavy part allowing the mass to oscillate in response to the movement of the timepiece and to the force of gravity.

The assembly 1 further comprises an element 4 which is stationary relative to the movement 2. The stationary element 4 is arranged under the winding mass 3, so that the movable mass 3 is configured to displace above the stationary element.

Said stationary element 4 comprises a first relief pattern and the winding mass 3 includes a second open-work pattern, so as to create a dynamic moiré effect when the winding mass 3 displaces on the stationary element 4. The winding mass 3 is preferably circular having a radial symmetry. Thus, a continuous visual effect is obtained when displacing the winding mass 3 above the stationary element 4.

In the embodiment shown in FIGS. 1 and 2, the winding mass 3 includes a ring 5, and a first open-work structure 7 assembled to the ring 5. The first structure 7 includes a plurality of through openings 28 defining the second pattern. The first open-work structure 7 is fixed inside the ring 5. The ring 5 and the first structure 7 are arranged in the same plane.

The fixed element 4 comprises a second relief structure 8 forming the first pattern. The second structure 8 is also open-worked, to form the relief of the first pattern.

The first 7 and the second 8 structure have a multi-stranded spiral shape 9, 11. The structures each have 8 strands 9, 11, the through openings 28 being defined between two strands 11. Each strand 9, 11 has a lightning shape having at least one step. The strands 9, 11 have the same shape and are repeated periodically around a central element 12, 16. The strands 9, 11 widen between the central element 12, 16 and the other end of the strands 9, 11.

The first 7 and the second structure 8 are similar. The first 7 and the second structure 8 have substantially equal dimensions. To achieve the moiré effect, the first 7 and the second structure 8 are superimposed. The structures 7, 8 are reversed from each other. For the winding mass 3, the end of each strand 9, 11 of the first structure 7 is fixed inside the ring 5.

To form the heavy part of the mass 3, the ring 5 comprises a high density insert 6. The insert 6 is formed of a high density material, preferably with a density greater than 10, or even 20. The high density material is, for example, tungsten or a tungsten alloy. The insert 6 is preferably overmoulded on the ring 5. The insert 6 has the shape of a circular arc, the thickness and height of which correspond to those of the ring, the arc forming an angle comprised between 20° and 50°. Other insert 6 shapes are obviously possible.

The winding mass 3, here the first structure 7 and the ring 5, is preferably formed of an amorphous metal, except for the heavy part. The amorphous metal is for example a zirconium-based alloy. Thus, the high density insert 6 can easily be overmoulded on the ring 5. The amorphous metal is, for example, injected at high pressure into a mould by a method of the High Pressure Die Casting type. It is also possible to form an amorphous metal disc, which is then laser cut to form the structure.

The stationary element 4 can be formed from another material, depending on the visual appearance that is desired. The stationary element 4 is thinner than the winding mass 3, in particular because of the insert 6 of the mass, which makes it thicker.

The stationary element 4 and the winding mass 3 are assembled together by the central elements 12, 16, which are associated around the axis 25 of the movement 2. The stationary element 4 does not rotate around the axis 25, while the winding mass 3 can rotate around the axis 25 above the stationary element 4.

Figure 3:
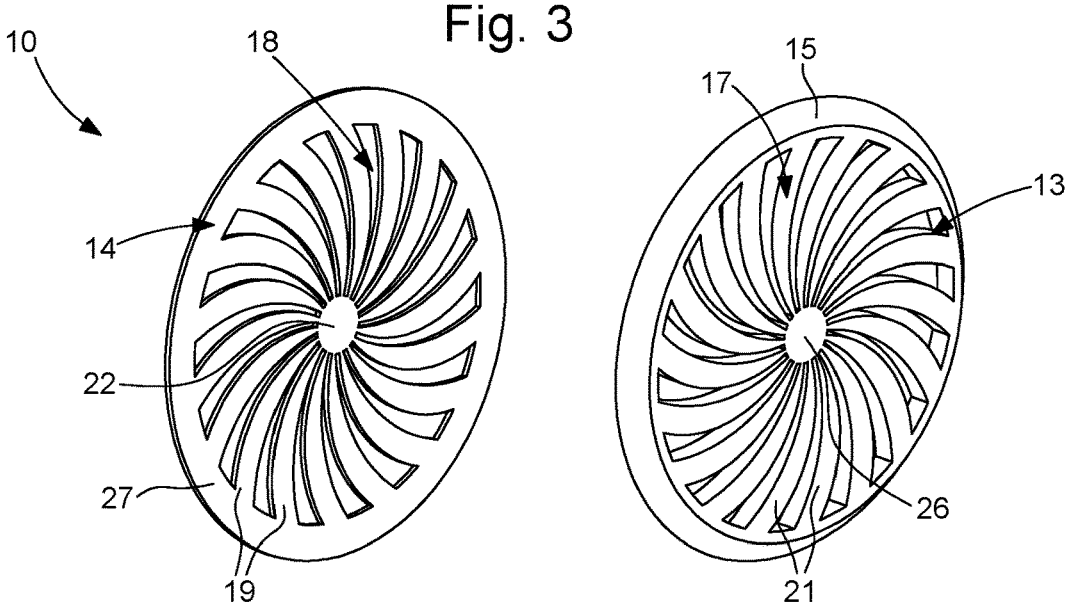
FIG. 3 is a plan view of a second embodiment of a winding assembly, the stationary element and the movable mass being separated.

FIG. 3 shows a variant of the previous embodiment. The assembly 10 comprises a winding mass 13 and a fixed element 14 which is similar to the first variant, but whose structures 17, 18 comprise eighteen strands 19, 21. The strands 19, 21 are arcs of a circle, which widen from the central element 22, 26 to the ring 15. Furthermore, the fixed element 14 also comprises a ring 27 wherein the first structure 18 is arranged. The assembly 10 is manufactured and mounted on an axis of a timepiece movement in a manner similar to the first variant embodiment. The ring comprises a high density insert arranged in its mass. The other features of this variant are the same as for the first variant.

The embodiments of the figures show exemplary embodiments of an assembly 1, 10 allowing to obtain a dynamic moiré effect. The invention is in no way limited to this example, and other embodiments are of course possible. It is for example possible to use conventional moiré effect patterns, wherein the first structure is provided with parallel ribs and the second structure comprises parallel blades. Displacing the parallel blades on the ribs allows to obtain a moiré effect.

The invention claimed is:

1. A moiré-effect winding assembly for an automatic timepiece movement, comprising:

an oscillating winding mass that is movable relative to the movement, said winding mass being configured to be mounted to rotate on an axis of the movement, part of the winding mass forming a heavy part allowing the mass to oscillate in response to the movement of the timepiece and to the force of gravity;

an element that is stationary relative to the movement, said stationary element being arranged under the winding mass, the winding mass being configured to at least partly displace above the stationary element, said stationary element comprising a first relief pattern and the winding mass including a plurality of through openings defining a second pattern, so as to create a dynamic moiré effect when the winding mass displaces above the stationary element.

2. The winding assembly according to claim 1, wherein the winding mass includes a first open-work structure forming the second pattern.

3. The winding assembly according to claim 2, wherein the winding mass includes a ring in which the first structure is assembled.

4. The winding assembly according to claim 3, wherein the winding mass comprises a high density insert forming the heavy part of the winding mass and wherein the insert is overmoulded on the ring.

5. The winding assembly according to claim 2, wherein the stationary element comprises a second open-work structure forming the first pattern.

6. The winding assembly according to claim 5, wherein the first and the second structure are identical.

7. The winding assembly according to claim 5, wherein the first and the second structure have substantially equal dimensions.

8. The winding assembly according to claim 5, wherein the first and the second structure have the shape of a multi-stranded spiral.

9. The winding assembly according to claim 1, wherein the winding mass comprises a high density insert forming the heavy part of the winding mass.

10. The winding assembly according to claim 9, wherein the insert comprises a high density material, with a density greater than 10.

11. The winding assembly according to claim 10, wherein the density of the high density material of the insert is greater than 20.

12. The winding assembly according to claim 10, wherein the high density material is tungsten or a tungsten alloy.

13. The winding assembly according to claim 1, wherein the winding mass comprises amorphous metal.

14. The winding assembly according to claim 13, wherein the amorphous metal of the winding mass comprises a zirconium-based alloy.

15. The winding assembly according to claim 13, wherein the winding mass comprises the amorphous metal entirely except for the heavy part.

16. A timepiece comprising:

a case formed of a middle part closed by a crystal and an at least partially transparent back and in which is housed an automatic winding horological movement, wherein said movement is equipped with the winding assembly according to claim 1.

* * * * *